US011641074B2

(12) United States Patent
Takasaki et al.

(10) Patent No.: US 11,641,074 B2
(45) Date of Patent: May 2, 2023

(54) CONNECTOR

(71) Applicant: SUMITOMO WIRING SYSTEMS, LTD., Mie (JP)

(72) Inventors: Koyo Takasaki, Mie (JP); Hiroto Sakai, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 58 days.

(21) Appl. No.: 17/473,337

(22) Filed: Sep. 13, 2021

(65) Prior Publication Data

US 2022/0094089 A1 Mar. 24, 2022

(30) Foreign Application Priority Data

Sep. 24, 2020 (JP) ..... JP2020-159756

(51) Int. Cl.

*H01R 12/71* (2011.01)
*H01R 13/42* (2006.01)
*H01R 13/50* (2006.01)
*H01R 12/70* (2011.01)

(52) U.S. Cl.

CPC ..... *H01R 12/716* (2013.01); *H01R 13/42* (2013.01); *H01R 13/50* (2013.01); *H01R 12/707* (2013.01)

(58) Field of Classification Search

CPC ..... H01R 12/716; H01R 13/42; H01R 13/50; H01R 12/707; H01R 12/724; H01R 13/41; H01R 12/57; H01R 13/40; H01R 12/71

See application file for complete search history.

(56) References Cited

U.S. PATENT DOCUMENTS 5,797,769 A * 8/1998 Yang ..... H01R 12/7064 439/571
5,921,789 A * 7/1999 Makino ..... H01R 12/716 439/590
5,957,705 A * 9/1999 David ..... H01R 12/7005 439/79
6,190,183 B1 * 2/2001 Yang ..... H01R 12/57 439/79

(Continued)

FOREIGN PATENT DOCUMENTS

JP 2012-199106 A 10/2012

*Primary Examiner* — Abdullah A Riyami
*Assistant Examiner* — Nelson R. Burgos-Guntin
(74) *Attorney, Agent, or Firm* — Venjuris, P.C.

(57) ABSTRACT

A connector includes a housing to be mounted on a circuit board, and an upper-stage terminal, a middle-stage terminal and a lower-stage terminal to be held in the housing. Leg portions of the respective upper-stage terminal and middle-stage terminal are arranged side by side in a width direction of a wall portion, and include each a wide portion and a narrow portion arranged below the wide portion. The wide portion of the upper-stage terminal protrudes only toward the middle-stage terminal with respect to the narrow portion of the upper-stage terminal. The wide portion of the middle-stage terminal protrudes only toward the middle-stage terminal with respect to the narrow portion of the upper-stage terminal. A leg portion of the lower-stage terminal is arranged between the narrow portion of the upper-stage terminal and the narrow portion of the middle-stage terminal in the width direction.

4 Claims, 4 Drawing Sheets

(56) References Cited

U.S. PATENT DOCUMENTS 6,482,016 B1 * 11/2002 McHugh ..... H01R 12/721 439/79
7,285,018 B2 * 10/2007 Kenny ..... H01R 13/719 439/620.01
10,056,710 B1 * 8/2018 Yang ..... H01R 13/518
10,236,645 B1 * 3/2019 Yang ..... H01R 13/5045
11,309,648 B1 * 4/2022 Huang ..... H01R 12/725
2003/0054678 A1 * 3/2003 Grek ..... H05K 1/147 439/79
2003/0082938 A1 * 5/2003 Yamaguchi ..... H01R 12/58 439/79
2005/0227534 A1 * 10/2005 Nakano ..... H01R 12/707 439/566
2006/0148316 A1 * 7/2006 Dillon ..... H01R 12/716 439/595
2007/0054548 A1 * 3/2007 Nakano ..... H01R 12/707 439/570
2007/0164475 A1 * 7/2007 Nagashima ..... B29C 45/14418 425/542
2008/0020630 A1 * 1/2008 Shinozaki ..... H01R 12/716 439/489
2009/0264019 A1 * 10/2009 Sakamoto ..... H01R 12/57 439/658
2012/0149228 A1 * 6/2012 Matsumoto ..... H01R 12/724 439/329
2017/0054233 A1 * 2/2017 Kikuchi ..... H01R 12/585
2019/0131727 A1 * 5/2019 Kishibata ..... H01R 12/716
2019/0131736 A1 * 5/2019 Obata ..... H01R 13/4364
2020/0136285 A1 * 4/2020 Kitajima ..... H01R 12/716
2020/0274270 A1 * 8/2020 Ito ..... H01R 13/41
2021/0359468 A1 * 11/2021 Guo ..... H01R 13/646
2022/0021141 A1 * 1/2022 Asano ..... H01R 12/724
2022/0077669 A1 * 3/2022 Hamada ..... H01H 85/56
2022/0094089 A1 * 3/2022 Takasaki ..... H01R 13/41
2022/0166171 A1 * 5/2022 Dedmon ..... H01R 13/502
2022/0200175 A1 * 6/2022 Price ..... H01R 13/05
2022/0247106 A1 * 8/2022 Makino ..... H01R 12/724
2022/0271473 A1 * 8/2022 Miyamura ..... H01R 13/4362
2022/0294134 A1 * 9/2022 Kishibata ..... H01R 12/7064
2022/0393375 A1 * 12/2022 Sato ..... H01R 43/0256

* cited by examiner

CONNECTOR

CROSS-REFERENCE TO RELATED APPLICATIONS

This application is based on and claims priority from Japanese Patent Application No. 2020-159756, filed on Sep. 24, 2020, with the Japan Patent Office, the disclosure of which is incorporated herein in their entireties by reference.

TECHNICAL FIELD

The present disclosure relates to a connector.

BACKGROUND

Japanese Patent Laid-open Publication Nos. 2012-199106 and 2020-071938 disclose a connector to be mounted on a circuit board. This connector includes a housing and a plurality of terminals to be held in the housing. Through holes are formed in upper, middle and lower stages of a wall portion of the housing. Upper-stage terminals, middle-stage terminals and lower-stage terminals are respectively inserted into the through holes in the upper, middle and lower stages. Each terminal includes a terminal connecting portion to be inserted into the through hole and a leg portion connected to the rear end of the terminal connecting portion and bent to extend downward.

The leg portions of the respective terminals need to be spaced apart by a certain distance or more so as not to be short-circuited to each other. Accordingly, in the connectors of Japanese Patent Laid-open Publication Nos. 2012-199106 and 2020-071938, the leg portions of the upper-stage terminals and the leg portions of the respective middle-stage terminals and lower-stage terminals are shifted in a front-rear direction.

SUMMARY

However, with the above configuration, a dimension in the front-rear direction of the connector increases. Accordingly, it is considered to arrange the leg portions of all the terminals in a row in a width direction. However, if all the leg portions are arranged in a row in the width direction, a reduction in installation intervals of the terminals merely by arranging the terminals in a row in the width direction is limited since the terminals need to be spaced apart by the certain distance or more.

Accordingly, the present disclosure aims to reduce installation intervals of terminals.

The present disclosure is directed to a connector with a housing to be mounted on a circuit board, and an upper-stage terminal, a middle-stage terminal and a lower-stage terminal to be held in the housing, wherein the housing includes a wall portion arranged along an up-down direction and a plurality of through holes penetrating through the wall portion, the plurality of through holes include an upper-stage through hole, a middle-stage through hole and a lower-stage terminal from an upper side toward a lower side, the upper-stage terminal passing through the upper-stage through hole, the middle-stage terminal passing through the middle-stage through hole, the lower-stage terminal passing through the lower-stage through hole, each of the upper-stage terminal, the middle-stage terminal and the lower-stage terminal includes a terminal connecting portion extending in a front-rear direction while being held in the through hole, and a leg portion connected to a rear end of the terminal connecting portion and extending downward, the leg portions of the respective upper-stage terminal and middle-stage terminal are arranged side by side in a width direction of the wall portion and include each a wide portion and a narrow portion arranged below the wide portion, the wide portion of the upper-stage terminal protrudes only toward the middle-stage terminal with respect to the narrow portion of the upper-stage terminal, the wide portion of the middle-stage terminal protrudes only toward the upper-stage terminal with respect to the narrow portion of the middle-stage terminal, and the leg portion of the lower-stage terminal is arranged between the narrow portion of the upper-stage terminal and the narrow portion of the middle-stage terminal in the width direction.

According to the present disclosure, it is possible to reduce installation intervals of terminals.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
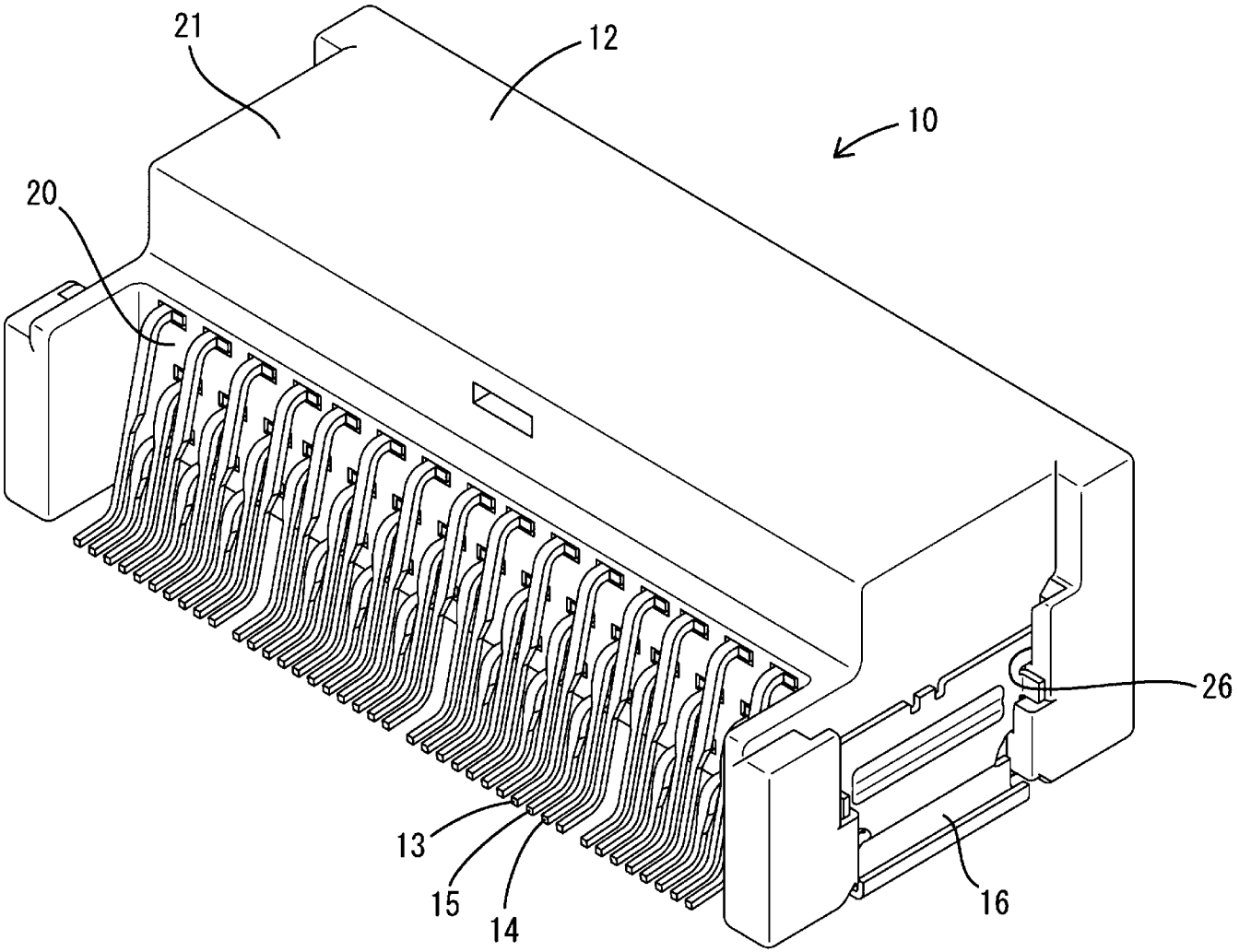
FIG. 1 is a perspective view of a connector in one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes a housing to be mounted on a circuit board, and an upper-stage terminal, a middle-stage terminal and a lower-stage terminal to be held in the housing, wherein the housing includes a wall portion arranged along an up-down direction and a plurality of through holes penetrating through the wall portion, the plurality of through holes include an upper-stage through hole, a middle-stage through hole and a lower-stage terminal from an upper side toward a lower side, the upper-stage terminal passing through the upper-stage through hole, the middle-stage terminal passing through the middle-stage through hole, the lower-stage terminal passing through the lower-stage through hole, each of the upper-stage terminal, the middle-stage terminal and the lower-stage terminal includes a terminal connecting portion extending in a front-rear direction while being held in the through hole, and a leg portion connected to a rear end of the terminal connecting portion and extending downward, the leg portions of the respective upper-stage terminal and middle-stage terminal are arranged side by side in a width direction of the wall portion and include each a wide portion and a narrow portion arranged below the wide portion, the wide portion of the upper-stage terminal protrudes only toward the middle-stage terminal with respect to the narrow portion of the upper-stage terminal, the wide portion of the middle-stage terminal protrudes only toward the upper-stage terminal with respect to the narrow portion of the middle-stage terminal, and the leg portion of the lower-stage terminal is arranged between the narrow portion of the upper-stage terminal and the narrow portion of the middle-stage terminal in the width direction.

In this connector, the wide portion of the upper-stage terminal protrudes only toward the middle-stage terminal with respect to the narrow portion of the upper-stage terminal. The wide portion of the middle-stage terminal protrudes only toward the upper-stage terminal with respect to the narrow portion of the middle-stage terminal. Thus, a large space in the width direction between the narrow portions of the upper-stage terminal and middle-stage terminal can be ensured while the strength of the upper-stage terminal and middle-stage terminal is enhanced by the wide portions. The leg portion of the lower-stage terminal is arranged in this space. Thus, the lower-stage terminal can be installed with good space efficiency. Therefore, according to this connector, installation intervals of the upper-stage terminal, the middle-stage terminal and the lower-stage terminal can be reduced.

(2) Preferably, the wide portion of the upper-stage terminal extends up to a position overlapping the wide portion of the middle-stage terminal in the width direction.

According to this configuration, the wide portion of the upper-stage terminal can be set long as compared to a configuration in which the wide portion of the upper-stage terminal does not overlap the wide portion of the middle-stage terminal in the width direction. Thus, the strength of the upper-stage terminal can be improved. Particularly, since the leg portion of the upper-stage terminal is formed longer in the up-down direction than the leg portions of the respective middle-stage terminal and lower-stage terminal and it is difficult to ensure sufficient strength, it is highly advantageous to adopt this configuration.

(3) Preferably, the terminal connecting portion includes a tab and a protruding portion arranged closer to a rear end than the tab and formed to be wider than the tab, and the wide portion of the upper-stage terminal and the wide portion of the middle-stage terminal are arranged at positions overlapping the protruding portion of the lower-stage terminal in the up-down direction in a back view.

According to this configuration, the installation intervals of the upper-stage terminal, the lower-stage terminal and the middle-stage terminal can be reduced while the strength of the upper-stage terminal and middle-stage terminal is enhanced.

(4) Preferably, each of the upper-stage terminal, the middle-stage terminal and the lower-stage terminal includes a board connecting portion extending rearward from a lower end of the leg portion, and the board connecting portions of the respective upper-stage terminal, middle-stage terminal and lower-stage terminal are arranged at positions overlapping in the width direction.

According to this configuration, an area occupied by the respective board connecting portions on a surface of the circuit board needs not be large in the front-rear direction. Particularly, the above configuration is easily adopted by arranging the leg portion of the lower-stage terminal between the narrow portion of the upper-stage terminal and the narrow portion of the middle-stage terminal.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

A connector 10 to be mounted on a circuit board 90 is illustrated in this embodiment. Note that, in the following description, a side of the connector 10 to be connected to a mating connector is referred to as a front side and an opposite side thereof is referred to as a rear side. Further, a side of the circuit board 90 with respect to the connector 10 is referred to as a lower side and an opposite side thereof is referred to as an upper side. Further, a lateral direction when the connector 10 is viewed from behind is referred to as a lateral direction.

Figure 2:
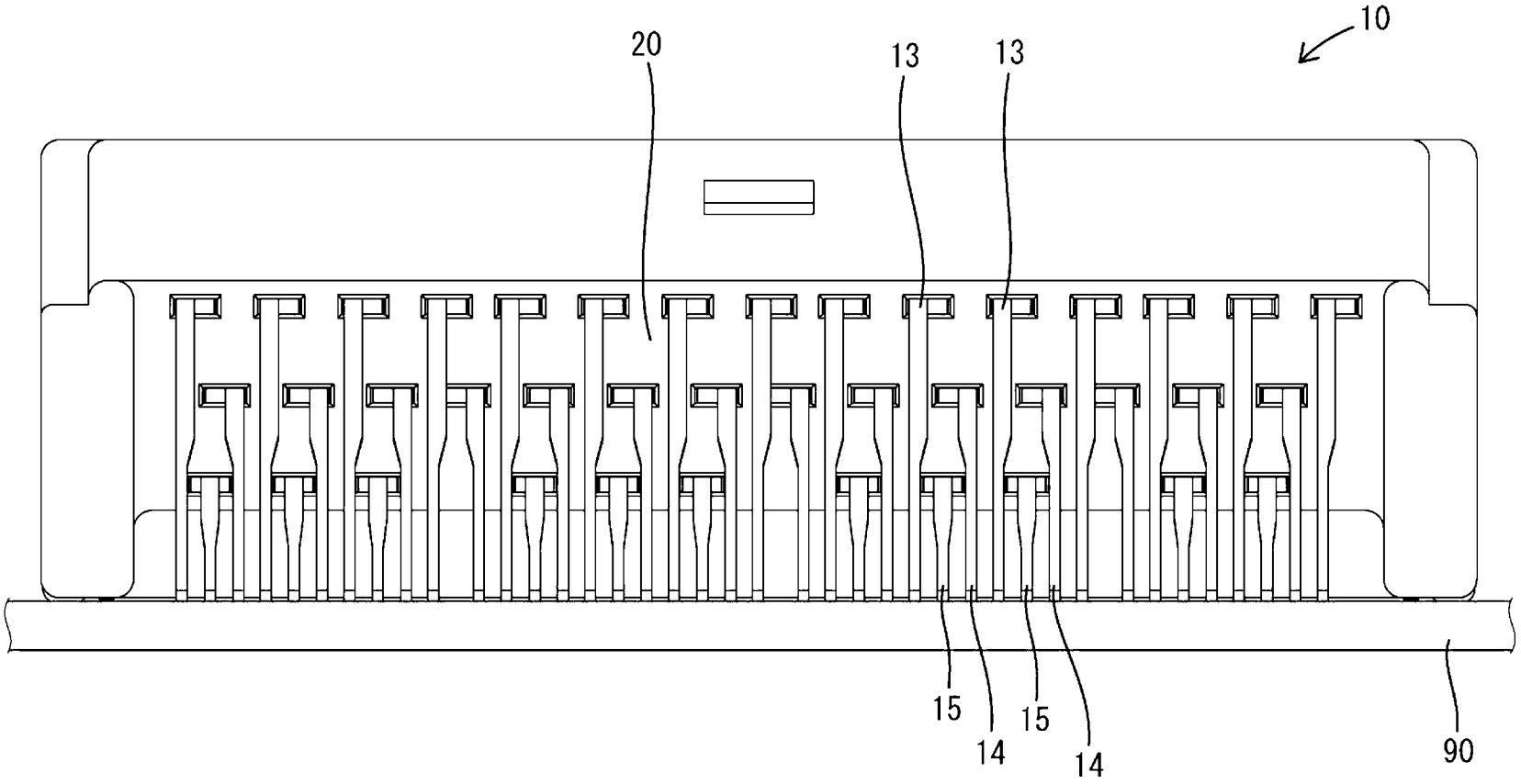
FIG. 2 is a back view of the connector of the one embodiment.

As shown in FIGS. 1 and 2, the connector 10 includes a housing 12, a plurality of upper-stage terminals 13, a plurality of middle-stage terminals 14, a plurality of lower-stage terminals 15 and a pair of mounting members 16. The upper-stage terminals 13, the middle-stage terminals 14 and the lower-stage terminals 15 are referred to as the terminals 13, 14 and 15 below unless it is necessary to distinguish them.

The housing 12 is made of synthetic resin and mounted on the circuit board 90. The housing 12 includes a wall portion 20 arranged along an up-down direction and the lateral direction, and a tubular receptacle 21 projecting forward from the outer periphery of the wall portion 20. In this embodiment, the lateral direction corresponds to an example of a "width direction of the wall portion". Mounting grooves 26 into which the mounting members 16 are mounted are formed in both left and right sides of the housing 12. The housing 12 is fixed to the circuit board 90 by soldering the mounting members 16 mounted into the mounting grooves 26 to the circuit board 90.

The housing 12 includes a plurality of upper-stage through holes 23, a plurality of middle-stage through holes 24 and a plurality of lower-stage through holes 25. The upper-stage through holes 23, the middle-stage through holes 24 and the lower-stage through holes 25 are referred to as the through holes 23, 24 and 25 below unless it is necessary to distinguish them. The through holes 23, 24 and 25 penetrate through the wall portion 20 in the front-rear direction. The upper-stage through holes 23, the middle-stage through holes 24 and the lower-stage through holes 25 are respectively arranged from an upper side toward a lower side. The plurality of upper-stage through holes 23, the plurality of middle-stage through holes 24 and the plurality of lower-stage through holes 25 are respectively arranged in a row in the lateral direction. The through holes 23, 24 and 25 have the same shape and size. The through holes 23, 24 and 25 have a rectangular shape longer in the lateral direction than in the up-down direction in a back view. The upper-stage through holes 23, the middle-stage through holes 24 and the lower-stage through holes 25 are arranged at positions overlapping in the up-down direction. The upper-stage through holes 23 are shifted leftward with respect to the lower-stage through holes 25 arranged at the positions overlapping in the up-down direction. The middle-stage through holes 24 are shifted rightward with respect to the lower-stage through holes 25 arranged at the positions overlapping in the up-down direction.

The aforementioned upper-stage terminals 13 are inserted into the upper-stage through holes 23 from behind and held through the upper-stage through holes 23. The aforementioned middle-stage terminals 14 are inserted into the middle-stage through holes 24 from behind and held through the middle-stage through holes 24. The aforementioned lower-stage terminals 15 are inserted into the lower-stage through holes 25 from behind and held through the lower-stage through holes 25.

Figure 3:
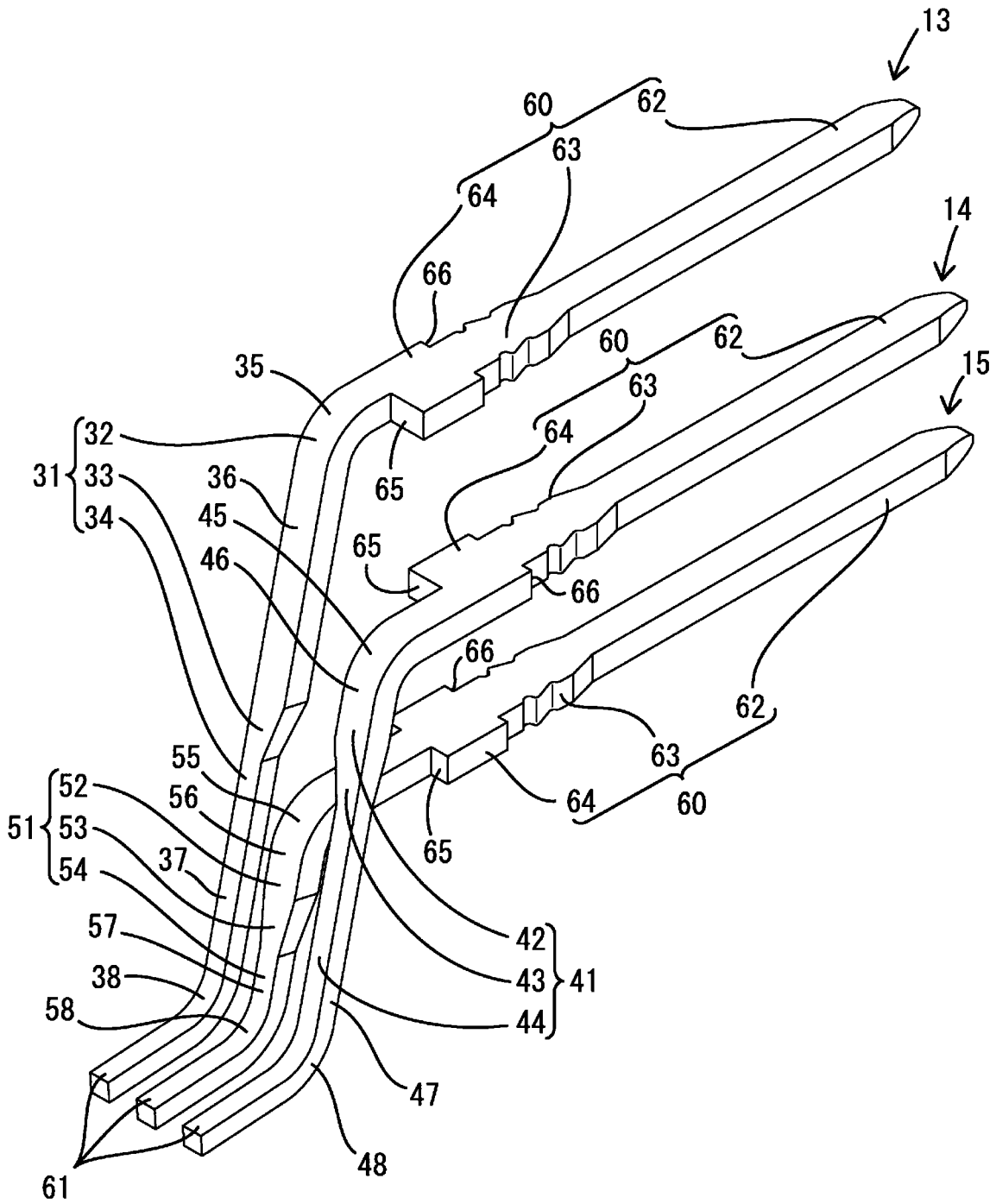
FIG. 3 is a perspective view of an upper-stage terminal, a lower-stage terminal and a middle-stage terminal of the one embodiment.

As shown in FIG. 3, the terminals 13, 14 and 15 are male terminals and respectively formed, such as by punching and bending a conductive metal plate. Each of the terminals 13, 14 and 15 has an elongated shape and includes a terminal connecting portion 60, a leg portion 31, 41, 51 and a board connecting portion 61.

The terminal connecting portion 60 extends in the front-rear direction while being held in the through hole 23, 24, 25. The terminal connecting portion 60 includes a tab 62, a locking portion 63 and a protruding portion 64. The tab 62 is arranged in the receptacle 21 of the housing 12 and connected to an unillustrated mating terminal provided in the mating connector with the connector 10 connected to the unillustrated mating connector. The locking portion 63 is arranged behind the tab 62. The locking portion 63 is configured as a press-fit projection projecting toward left and right sides, and locked to the inner peripheral surface of the through hole 23, 24, 25 by being press-fit. The protruding portion 64 is arranged behind the locking portion 63 and shaped to protrude further in the lateral direction than the tab 62. The protruding portion 64 has a rectangular shape longer in the lateral direction than in the up-down direction in a back view, and has a rectangular shape in a plan view. The terminal 13, 14, 15 is press-fit into the through hole 23, 24, 25 by a rear surface 65 of the protruding portion 64 being pressed forward by a jig or the like. A forward displacement of the pressed terminal 13, 14, 15 is restricted by a front surface 66 of the protruding portion 64 butting against a restricting surface in the through hole 23, 24, 25.

The leg portion 31, 41, 51 of the terminal 13, 14, 15 is connected to the rear end (in particular, rear surface 65 of the protruding portion 64) and extends downward. The leg portions 31, 41 and 51 are arranged side by side in a row in the lateral direction. A height of the leg portions 31 of the upper-stage terminals 13 is larger than that of the leg portions 41 of the middle-stage terminals 14. A height of the leg portions 41 of the middle-stage terminals 14 is larger than that of the leg portions 51 of the lower-stage terminals 1*t*. The leg portions 31, 41 and 51 of the respective upper-stage terminals, middle-stage terminals and lower-stage terminals 13, 14 and 15 are so arranged that height positions of lower ends are aligned. The leg portion 31, 41, 51 includes a wide portion 32, 42, 52, a reduced-width portion 33, 43, 53 and a narrow portion 34, 44, 54 having a smaller lateral width than the wide portion 32, 42, 52.

The wide portion 32, 42, 52 includes a wide bent portion 35, 45, 55 connected to the rear end of the terminal connecting portion 60 (in particular, protruding portion 64) and bent downward in a curved manner, and a wide planar portion 36, 46, 56 extending downward from the lower end of the wide bent portion 35, 45, 55. A lateral width of the wide portion 32, 42, 52 is constant and larger than a thickness of the wide portion 32, 42, 52.

The reduced-width portion 33, 43, 53 extends downward from the lower end of the wide portion 32, 42, 52 and has a width reduced toward a lower side. A width of the upper end of the reduced-width portion 33, 43, 53 is equal to that of the lower end of the wide portion 32, 42, 52. A width of the lower end of the reduced-width portion 33, 43, 53 is equal to that of the upper end of the narrow portion 34, 44, 54.

The narrow portion 34, 44, 54 is arranged below the wide portion 32, 42, 52. The narrow portion 34, 44, 54 includes a reduced-width planar portion 37, 47, 57 connected to the lower end of the wide portion 32, 42, 52 via the reduced-width portion 33, 43, 53 and extending downward, and a narrow bent portion 38, 48, 58 connected to the lower end of the reduced-width planar portion 37, 47, 57 and bent rearwardly in a curved manner. A lateral width of the narrow portion 34, 44, 54 is constant and equal to a thickness of the narrow portion 34, 44, 54.

Figure 4:
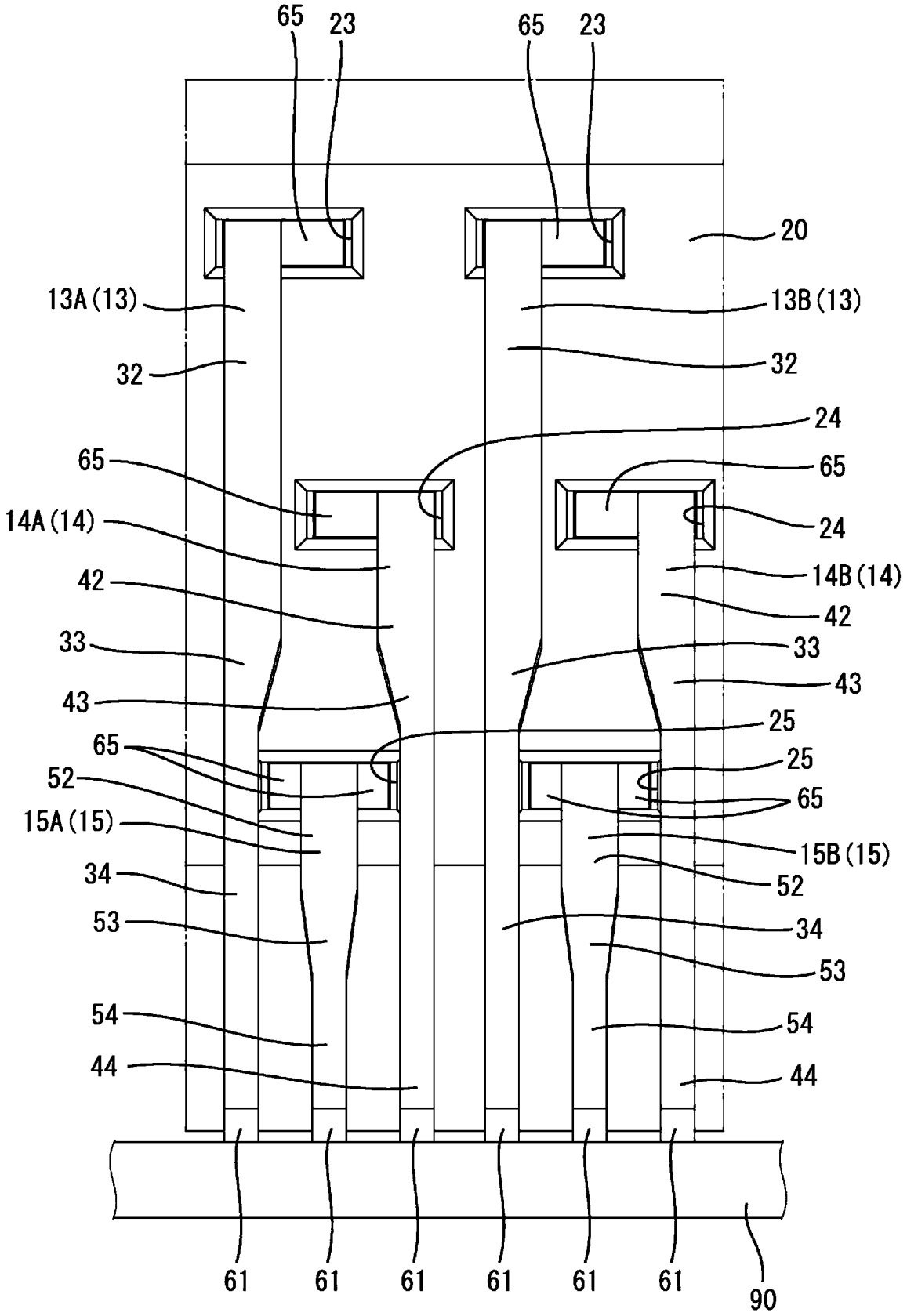
FIG. 4 is an enlarged view of a region including the upper-stage terminals, the lower-stage terminals and the middle-stage terminals shown in FIG. 2.

The leg portions 31, 41 and 51 of the terminals 13, 14 and 15 are repeatedly arranged in the order of the leg portion 31 of the upper-stage terminal 13, the leg portion 51 of the lower-stage terminal 15 and the leg portion 41 of the middle-stage terminal 14 toward a right side. In an example shown in FIG. 4, the leg portions 31, 51, 41 of the upper-stage terminal 13A, the lower-stage terminal 15A, the middle-stage terminal 14A, the upper-stage terminal 13B, the lower-stage terminal 15B and middle-stage terminal 14B are successively arranged. The following description is focused on a set of the upper-stage terminal 13A, the middle-stage terminal 14A and the lower-stage terminal 15A.

The protruding portions 64 of the respective upper-stage terminal 13A, middle-stage terminal 14A and lower-stage terminal 15A are arranged at positions overlapping in the up-down direction. The protruding portion 64 of the upper-stage terminal 13A is shifted leftward with respect to the protruding portion 64 of the lower-stage terminal 15A. The protruding portion 64 of the middle-stage terminal 14A is shifted rightward with respect to the protruding portion 64 of the lower-stage terminal 15A. The leg portion 31 of the upper-stage terminal 13A is arranged on a left side, and the leg portion 41 of the middle-stage terminal 14A is arranged on a right side. The leg portion 51 of the lower-stage terminal 15A is arranged between the leg portion 31 of the upper-stage terminal 13A and the leg portion 41 of the middle-stage terminal 14A in the lateral direction.

The leg portion 31 of the upper-stage terminal 13A is connected to a left part of the rear surface 65 of the protruding portion 64. Note that a right part of the rear surface 65 of the protruding portion 64 of the upper-stage terminal 13A functions as a pressing surface to be pressed by the jig or the like. The left surface of the leg portion 31 of the upper-stage terminal 13A extends in the up-down direction without any step. The right surface of the leg portion 31 of the upper-stage terminal 13A is inclined leftward toward a lower side in the reduced-width portion 33. In other words, the wide portion 32 and the reduced-width portion 33 of the upper-stage terminal 13A protrude only rightward with respect to the narrow portion 34, but do not protrude leftward.

The leg portion 41 of the middle-stage terminal 14A is connected to a right part of the rear surface 65 of the protruding portion 64. Note that a left part of the rear surface 65 of the protruding portion 64 of the middle-stage terminal 14A functions as a pressing surface. The right surface of the leg portion 41 of the middle-stage terminal 14A extends in the up-down direction without any step. The left surface of the leg portion 41 of the middle-stage terminal 14A is inclined rightward toward a lower side in the reduced-width portion 43. In other words, the wide portion 42 and the reduced-width portion 43 of the middle-stage terminal 14A protrude only leftward with respect to the narrow portion 44, but do not protrude rightward. The aforementioned wide portion 32 of the upper-stage terminal 13A extends up to a position overlapping the wide portion 42 of the middle-stage terminal 14A in the lateral direction. The reduced-width portion 33 of the upper-stage terminal 13A extends up to a position overlapping the reduced-width portion 43 of the middle-stage terminal 14A in the lateral direction.

The leg portion 51 of the lower-stage terminal 14A is connected to a laterally central part of the rear surface 65 of the protruding portion 64. Note that both left and right sides of the rear surface 65 of the protruding portion 64 of the lower-stage terminal 14A function as pressing surfaces. The leg portion 51 and the protruding portion 64 of the lower-stage terminal 15A are arranged between the narrow portion 34 of the upper-stage terminal 13A and the narrow portion 44A of the middle-stage terminal 14A. In other words, the leg portion 51 and the protruding portion 64 of the lower-stage terminal 15A are arranged to be lower than the wide portion 32 of the upper-stage terminal 13A and the wide portion 42 of the middle-stage terminal 14A and the reduced-width portion 53 of the upper-stage terminal 13A and the reduced-width portion 43 of the middle-stage terminal 14A. Both left and right surfaces of the reduced-width portion 53 of the lower-stage terminal 15A are inclined laterally inwardly toward a lower side. The wide portion 32 of the upper-stage terminal 13A and the wide portion 42 of the middle-stage terminal 14A described above are arranged at positions overlapping the protruding portion 64 of the lower-stage terminal 15A in the up-down direction in a back view.

The board connecting portion 61 is connected to the lower end of the leg portion 31, 41, 51 (in particular, narrow bent portion 38, 48, 58) of the terminal 13, 14, 15 and extends rearward. A width of the board connecting portion 61 is equal to that of the narrow portion 34, 44, 54. The board connecting portion 61 is soldered to a conductive path formed on the surface of the circuit board 90. The board connecting portions 61 of the respective upper-stage terminals 13, middle-stage terminals 14 and lower-stage terminals 15 are arranged at positions overlapping in the lateral direction. The rear ends of the respective board connecting portions 61 are arranged at the same position in the front-rear direction.

Next, a manufacturing method of the connector 10 is described. The upper-stage terminals 13, the middle-stage terminals 14 and the lower-stage terminals 15 are respectively inserted into the upper-stage through holes 23, the middle-stage through holes 24 and the lower-stage through holes 25 of the housing 12 from behind. The terminals 13, 14 and 15 are press-fit into the through holes 23, 24 and 25 by having the rear surfaces 65 of the protruding portions 64 pressed by the jig or the like. The terminals 13, 14 and 15 are positioned by the front surfaces 66 of the protruding portions 64 butting against the restricting surfaces in the through holes 23, 24 and 25. The mounting members 16 are mounted into the mounting grooves 26 on both left and right sides of the housing 12. In this way, the connector 10 is completed. The conductive paths are formed on the surface of the circuit board 90 and solder paste is applied at necessary positions. The connector 10 is placed on the circuit board 90 and reflow soldered to the circuit board 90. In particular, the mounting members 16 are soldered to the circuit board 90 and the board connecting portions 61 of the respective terminals 13, 14 and 15 are soldered to the conductive paths formed on the circuit board 90.

As described above, in the connector 10 of this embodiment, the wide portion 32 of the upper-stage terminal 13A protrudes only toward the middle-stage terminal 14A with respect to the narrow portion 34 of the upper-stage terminal 13A. The wide portion 42 of the middle-stage terminal 14A protrudes only toward the upper-stage terminal 13A with respect to the narrow portion 44 of the middle-stage terminal 14A. Thus, a large space in the width direction between the narrow portions 34 and 44 of the upper-stage terminal 13A and the middle-stage terminal 14A can be ensured while the strength of the upper-stage terminal 13A and the middle-stage terminal 14A is enhanced by the wide portions 32, 42. The leg portion 51 of the lower-stage terminal 15A is arranged in this space. Thus, the lower-stage terminal 15A can be installed with good space efficiency. Therefore, according to this connector 10, installation intervals of the upper-stage terminal 13A, the middle-stage terminal 14A and the lower-stage terminal 15A can be reduced.

Further, the wide portion 32 of the upper-stage terminal 13A extends up to the position overlapping the wide portion 42 of the middle-stage terminal 14A in the lateral direction. Thus, the wide portion 32 of the upper-stage terminal 13A can be set long as compared to a configuration in which the wide portion 32 of the upper-stage terminal 13A does not overlap the wide portion 42 of the middle-stage terminal 14A in the lateral direction. Thus, the strength of the upper-stage terminal 13A can be improved. Particularly, since the leg portion 31 of the upper-stage terminal 13A is formed longer in the up-down direction than the leg portions 41, 51 of the respective middle-stage terminal 14A and lower-stage terminal 15A and it is difficult to ensure sufficient strength, it is highly advantageous to adopt this configuration.

Further, the wide portion 32 of the upper-stage terminal 13A and the wide portion 32 of the middle-stage terminal 14A described above are arranged at the positions overlapping the protruding portion 64 of the lower-stage terminal 15A in the up-down direction. Thus, the installation intervals of the upper-stage terminal 13A, the middle-stage terminal 14A and the lower-stage terminal 15A can be reduced while the strength of the upper-stage terminal 13A and the middle-stage terminal 14A is enhanced.

Further, the board connecting portions 61 of the respective upper-stage terminal 13A, middle-stage terminal 14A and lower-stage terminal 15A are arranged at the positions overlapping in the lateral direction. Thus, an area occupied by the respective board connecting portions 61 on the surface of the circuit board 90 needs not be large in the front-rear direction. Particularly, the above configuration is easily adopted by arranging the leg portion 51 of the lower-stage terminal 15A between the narrow portion 34 of the upper-stage terminal 13A and the narrow portion 44 of the middle-stage terminal 14A in the lateral direction.

Other Embodiments of Present Disclosure

The embodiment disclosed this time should be considered illustrative in all aspects, rather than restrictive.

(1) Although the wide portion of the upper-stage terminal does not protrude leftward with respect to the narrow portion in the above embodiment, the wide portion may protrude leftward. Further, although the wide portion of the middle-stage terminal does not protrude rightward with respect to the narrow portion in the above embodiment, the wide portion may protrude rightward.

(2) Although the lower-stage terminal includes both the wide portion and narrow portion in the above embodiment, the lower-stage terminal may include only the wide portion without including the narrow portion.

(3) The terminal connecting portion may extend in the front-rear direction as a whole and may be inclined with respect to the front-rear direction (e.g. a direction parallel to the surface of the circuit board). Similarly, the leg portion may be shaped to extend in the up-down direction as a whole and may be inclined with respect to the up-down direction (e.g. a direction perpendicular to the surface of the circuit board). Further, the front-rear direction may be different from a horizontal direction and the up-down direction may be different from a vertical direction when the connector is used.

(4) Although the leg portions of the upper-stage terminal, the middle-stage terminal and the lower-stage terminal include the reduced-width portion in the above embodiment, these leg portions may include no reduced-width portion. That is, the wide portions may be directly connected to the narrow portions.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising:

a housing to be mounted on a circuit board; and an upper-stage terminal, a middle-stage terminal and a lower-stage terminal to be held in the housing, wherein:

the housing includes a wall portion arranged along an up-down direction and a plurality of through holes penetrating through the wall portion, the plurality of through holes include an upper-stage through hole, a middle-stage through hole and a lower-stage terminal from an upper side toward a lower side, the upper-stage terminal passing through the upper-stage through hole, the middle-stage terminal passing through the middle-stage through hole, the lower-stage terminal passing through the lower-stage through hole, each of the upper-stage terminal, the middle-stage terminal and the lower-stage terminal includes a terminal connecting portion extending in a front-rear direction while being held in the through hole, and a leg portion connected to a rear end of the terminal connecting portion and extending downward, the leg portions of the respective upper-stage terminal and middle-stage terminal are arranged side by side in a width direction of the wall portion and include each a wide portion and a narrow portion arranged below the wide portion, the wide portion of the upper-stage terminal protrudes only toward the middle-stage terminal with respect to the narrow portion of the upper-stage terminal, the wide portion of the middle-stage terminal protrudes only toward the upper-stage terminal with respect to the narrow portion of the middle-stage terminal, and the leg portion of the lower-stage terminal is arranged between the narrow portion of the upper-stage terminal and the narrow portion of the middle-stage terminal in the width direction.

2. The connector of claim 1, wherein the wide portion of the upper-stage terminal extends up to a position overlapping the wide portion of the middle-stage terminal in the width direction.

3. The connector of claim 1, wherein:

the terminal connecting portion includes a tab and a protruding portion arranged closer to a rear end than the tab and formed to be wider than the tab, and the wide portion of the upper-stage terminal and the wide portion of the middle-stage terminal are arranged at positions overlapping the protruding portion of the lower-stage terminal in the up-down direction in a back view.

4. The connector of claim 1, wherein:

each of the upper-stage terminal, the middle-stage terminal and the lower-stage terminal includes a board connecting portion extending rearward from a lower end of the leg portion, and the board connecting portions of the respective upper-stage terminal, middle-stage terminal and lower-stage terminal are arranged at positions overlapping in the width direction.

* * * * *